US008240984B2

(12) United States Patent
Noelle

(10) Patent No.: US 8,240,984 B2
(45) Date of Patent: Aug. 14, 2012

(54) VARIABLE GEOMETRY COMPRESSOR MODULE

(75) Inventor: Phillipe Noelle, Vincey (FR)

(73) Assignee: Honeywell International Inc., Morristown, NJ (US)

( * ) Notice: Subject to any disclaimer, the term of this patent is extended or adjusted under 35 U.S.C. 154(b) by 1233 days.

(21) Appl. No.: 11/989,735

(22) PCT Filed: Aug. 2, 2005

(86) PCT No.: PCT/US2005/027572

§ 371 (c)(1),
(2), (4) Date: Jan. 30, 2008

(87) PCT Pub. No.: WO2007/018529

PCT Pub. Date: Feb. 15, 2007

(65) Prior Publication Data

US 2009/0155058 A1 Jun. 18, 2009

(51) Int. Cl.
*F01D 25/24* (2006.01)

(52) U.S. Cl. ..... 415/164; 415/206; 415/211.2; 415/214.1

(58) Field of Classification Search ..... 415/160, 415/163, 164, 165, 206, 214.1, 191; 29/889.2
See application file for complete search history.

(56) References Cited

U.S. PATENT DOCUMENTS

| | | | | |
|---|---|---|---|---|
| 3,495,921 | A * | 2/1970 | Swearingen | 415/163 |
| 3,799,694 | A * | 3/1974 | Duzan | 415/161 |
| 3,992,128 | A * | 11/1976 | Lunsford et al. | 415/161 |
| 4,338,063 | A | 7/1982 | Nakanishi | |
| 4,657,476 | A * | 4/1987 | Berg | 415/48 |
| 4,770,605 | A * | 9/1988 | Nakatomi | 415/148 |
| 5,207,559 | A | 5/1993 | Clevenger et al. | |
| 5,851,104 | A * | 12/1998 | Dakin et al. | 415/150 |
| 5,913,248 | A * | 6/1999 | Harada et al. | 73/861.47 |
| 6,506,011 | B1 | 1/2003 | Sishtla | |
| 6,679,057 | B2 * | 1/2004 | Arnold | 60/602 |

FOREIGN PATENT DOCUMENTS

| | | |
|---|---|---|
| DE | 3844189 | 12/1988 |
| EP | 0685652 A2 | 6/1995 |
| EP | 1413763 A1 | 4/2004 |

OTHER PUBLICATIONS

Honeywell PCT ISR/WO PCT/EP2004/012992.

* cited by examiner

*Primary Examiner* — Ninh H Nguyen
(74) *Attorney, Agent, or Firm* — Brian Pangrle

(57) ABSTRACT

A variable geometry compressor housing module has a housing (1) into which a diffuser plate (3), a unison ring (5) and vanes (7) supported by a backplate (9) are inserted. The backplate is fixed to the housing by a crimping process. An actuation mechanism (13) for actuating the vanes (7) is provided on an inlet side of the housing (1). Furthermore, a shroud groove is partly defined by the diffuser plate (3).

31 Claims, 11 Drawing Sheets

Clearance value d6 = d1 + d2 - d3 - d4 - d5
Clearance tolerance Told6 = Told1 + Told2 + Told3 + Told4 + Told5
St Dev Clearance d6 = Square root (St Devd1 + St Devd2 + St Devd3 + St Devd4 + St Devd5)

VARIABLE GEOMETRY COMPRESSOR MODULE

The invention relates to a vane cartridge for a variable geometry compressor, to a variable geometry compressor housing, a variable geometry compressor housing module and to a method to manufacture a variable geometry compressor housing module.

Known variable geometry compressor systems with pivot vane configurations require that the vanes be assembled as integral parts of a center housing. When manufacturing such a compressor system all components are assembled in the same place. This manufacturing process requires a certain amount of time. Furthermore, the assembly work is to be done by highly skilled staff for correctly assembling the vane mechanism.

There exists a need for a housing and a housing module for a variable geometry compressor that is more easily calibrated, as well as for a method for manufacturing such a variable geometry compressor housing module.

According to a first aspect of the present invention, a variable geometry compressor device comprises two wall members attached to each other. Between the two wall members a set of adjustable vanes and a unison ring for actuating said vanes is housed. Thus, a vane cartridge is formed.

As an advantageous development a groove can be provided in one of the wall members, in which the unison ring is received.

Furthermore, advantageously each of said vanes can be provided with a pivot axle near its tip. The pivot axle is housed in a hole which is provided in one of said wall members. Furthermore, each vane is provided with a tab near its rear end. The tab is housed in a guide slot which is provided in said unison ring.

In order to maintain a predetermined distance between the wall members spacers are provided.

The variable geometry compressor device according to the first aspect provides the advantage, that the vane cartridge can be assembled as a sub assembly of a compressor housing. Thus, it is possible to calibrate the vanes and the unison ring, and further, to aerodynamically test a compressor housing into which the vane cartridge was inserted, before the housing is attached to a center housing and rotating assembly. Furthermore, it is possible to test the functionality of the vane cartridge by inserting it to s special testing device before it is inserted into the housing.

According to a second aspect of the invention, a variable geometry compressor housing comprises an inlet, a volute, and a shroud groove provided in said inlet. Furthermore, a diffuser plate is provided and inserted into the housing. A radially inner portion of the diffuser plate at least partly defines the shroud groove.

Advantageously, a radially outer portion of the diffuser plate forms a part of the volute. This makes it possible to form the housing in a die casting process. Furthermore, a backplate may be fixed to the housing by a crimping process.

An actuation mechanism is advantageously provided on the inlet side of the housing.

According to a third aspect of the invention, a variable geometry compressor housing comprises an inlet, a volute, and a shroud groove provided in said inlet. Furthermore, a diffuser plate is provided and inserted into the housing. An actuating mechanism is provided on the inlet side of the housing.

Advantageously, a radially outer portion of the diffuser plate forms a part of the volute. This makes it possible to form the housing in a die casting process. Furthermore, a backplate may be fixed to the housing by a crimping process.

Also advantageously, the shroud groove is partly defined by a radially inner portion of the diffuser plate.

According to a fourth aspect of the invention, a variable geometry compressor housing module comprises a compressor housing having a volute, an inlet, and a shroud groove provided in said inlet. A diffuser plate is inserted into the housing and has a radially inner portion which at least partly defines the shroud groove. Furthermore, the diffuser plate has a guide means on a side opposite the volute for guiding a unison ring. The unison ring serves to actuate a set of adjustable vanes which are supported by a backplate fixed to said housing.

Advantageously, the housing is formed in a die casting process. In the case of the die casted housing, a radially outer portion of said diffuser plate defines at least a part of said volute.

Furthermore, the backplate may be fixed to the housing by a crimping process. By this crimping process the backplate is tightly fixed, resulting in that further fixing means such as e.g. bolts, or sealing means such as e.g. O-rings may be omitted.

A clearance between the set of vanes and the backplate may be defined by machining of the contact surface between the housing and the backplate and of the contact surface between the housing and the diffuser plate in one clamping. Therefore, merely the thickness dimension of the vanes must have a required tolerance. Thus, defining a clearance for the vanes as required is facilitated.

The guide means for the unison ring may be provided in the diffuser plate on a side opposite the volute. Thus, the pre-assembly of the diffuser plate, unison ring, vanes and backplate is facilitated.

Advantageously, the backplate, the diffuser plate and the unison ring may have a low friction coating. If, in this case, the vanes are pressed against the backplate by a biasing force for avoiding a clearance between the vanes and the backplate or between the vanes and the unison ring, the friction occurring between the respective components is reduced by the low friction coating.

Advantageously, the backplate may be provided with an attachment flange on a side opposite the volute. Thus, the whole variable geometry compressor housing module can be easily attached to other parts.

An actuation mechanism for the set of vanes may be located on the inlet side of the housing. This arrangement advantageously keeps the actuation mechanism readily accessible and in a relatively cool area of the compressor housing.

According to a fifth aspect of the invention a variable geometry compressor housing module comprises a compressor housing having a volute, an inlet and a shroud groove which is provided in the inlet. Furthermore, the housing has a guide means for guiding a unison ring which actuates a set of adjustable vanes. The vanes are supported by a backplate which is fixed to the housing. An actuation mechanism for actuating said adjustable vanes and the unison ring is located on an inlet side of the housing. This arrangement advantageously keeps the actuation mechanism in a relatively cool area of the compressor housing.

Preferably, the housing has a separate diffuser plate. A radially outer portion of the diffuser plate defines the volute. Thus, it is possible to form the housing in a die casting process. Guide means are provided in said diffuser plate on a side opposite the volute.

Furthermore, advantageous developments correspond to and can be carried out according to those of the third aspect of the invention.

According to another aspect of the invention, a method for manufacturing a variable geometry compressor housing module comprises the steps of providing a die cast compressor housing, inserting a diffuser plate a radially outer portion of which at least partly defines a volute in the compressor housing and a radially inner portion of which at least partly defines a shroud groove. Furthermore, the method according to this aspect comprises the steps of inserting an assembly consisting of a unison ring, a set of vanes and a backplate into the housing such that the unison ring is housed in a groove which is provided in the diffuser plate. The backplate is attached to the compressor housing by crimping.

Furthermore, advantageously, the method can comprise a step of machining a contact surface between the housing and the backplate as well as a contact surface between the housing and the diffuser plate in one clamping. Thus, it is possible to adjust a distance of said set of vanes to the backplate.

According to another aspect, a method for manufacturing a variable geometry compressor housing module comprises the steps of providing a die cast compressor housing, inserting a diffuser plate into the compressor housing a radially outer portion of which at least partly defines a volute, and inserting an assembly consisting of a unison ring, a set of vanes and a backplate into the housing. The unison ring is housed in a groove provided in the diffuser plate. An actuation mechanism for adjusting the set of vanes is provided at an inlet side of the housing and connected with the set of vanes. The backplate is attached to the compressor housing by crimping. Thus, a pre-assembled variable geometry compressor housing module is provided, which can be readily calibrated before it is fixed to the remainder of a turbo charger.

Furthermore, advantageously, the method can comprise a step of machining a contact surface between the housing and the backplate as well as machining a contact surface between the housing and the diffuser plate in one clamping. Thus, it is possible to adjust a distance of the set of vanes to the backplate.

The invention will now be explained in detail, using preferred embodiments as examples, wherein reference is made to the drawings, in which.

Figure 1:
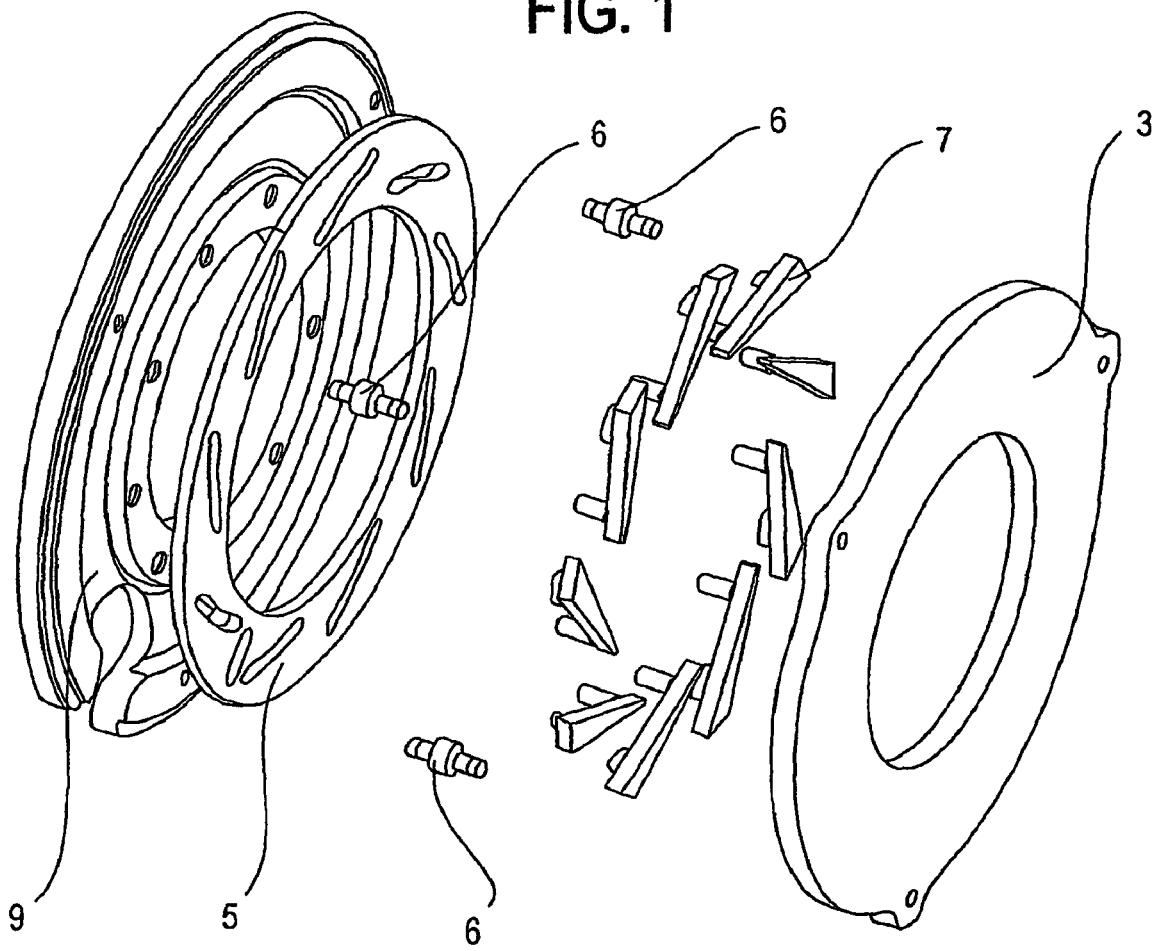
FIG. 1 shows a perspective view of components for a vane cartridge according to the present invention.

FIG. 1 shows a perspective view of components for a vane cartridge according to the present invention. Substantially, the vane cartridge consists of diffuser plate 3 and a backplate 9 between which plates a set of vanes 7 (nine as illustrated, though more or less could be used with similar effect) and a unison ring 5 are inserted. The diffuser plate 3 and the backplate 9 correspond to wall members.

When seen from the top the vanes 7 have a substantially triangular shape. One edge of the triangle has a substantially shorter length than the other two edges. Thus, the two longer edges define a tip of each vane 7 while the shorter edge defines a rear side.

Near the tip end of each vane 7 a pivot axle is provided. Furthermore, near the rear end of each vane a tab is provided. The pivot axle as well as the tab protrude from the same face.

The unison ring 5 has a thickness corresponding to the length of the vane tabs. According to the number of vanes 7 the unison ring 5 has nine guide slots for receiving the vane tabs. Furthermore, the unison ring has a radial slot to come into engagement with an actuating mechanism.

The unison ring 5 is received in a groove which is provided in the backplate 9. Furthermore, the pivot axles of the vanes are received in circular holes provided on a radial inner side of the groove.

When assembling the vane cartridge, the unison ring 5 is inserted into the groove in the backplate 9. Next, the pivot axles of each vane are inserted into the respective holes in the backplate 9, while the vane tabs are inserted into the guide slots of the unison ring. Thereafter, the diffuser plate 3 and the backplate 9 are attached to each other, for which purpose spacers 6 are used.

Essentially the spacers 6 are cylindrical and have a thickened middle portion. At their end portions, the spacers come into engagement with respective holes provided in the backplate 9 and diffuser plate 3, respectively. Thus, the distance between the diffuser plate 3 and the backplate 9 is defined by the length of the thickened portion of the spacers 6.

Figure 2:
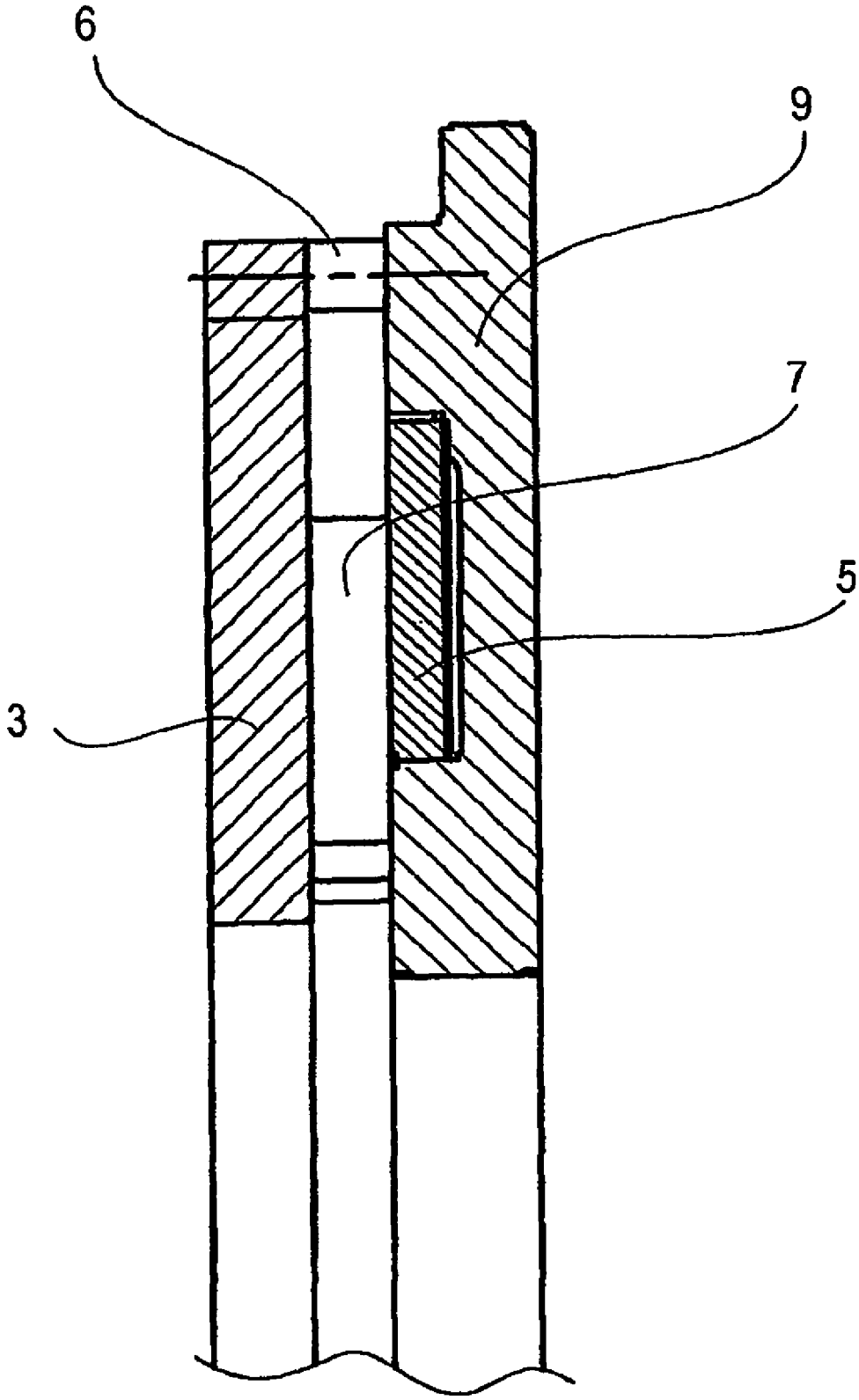
FIG. 2 shows a cross sectional view of a portion of the vane cartridge of FIG. 1.

Thereby the vane cartridge is formed. FIG. 2 shows a section of a portion of the vane cartridge after the assembly. It can be seen from FIG. 2, that the distance between the backplate 9 and the diffuser plate 3 slightly exceeds the thickness of the vanes 7.

Figure 3:
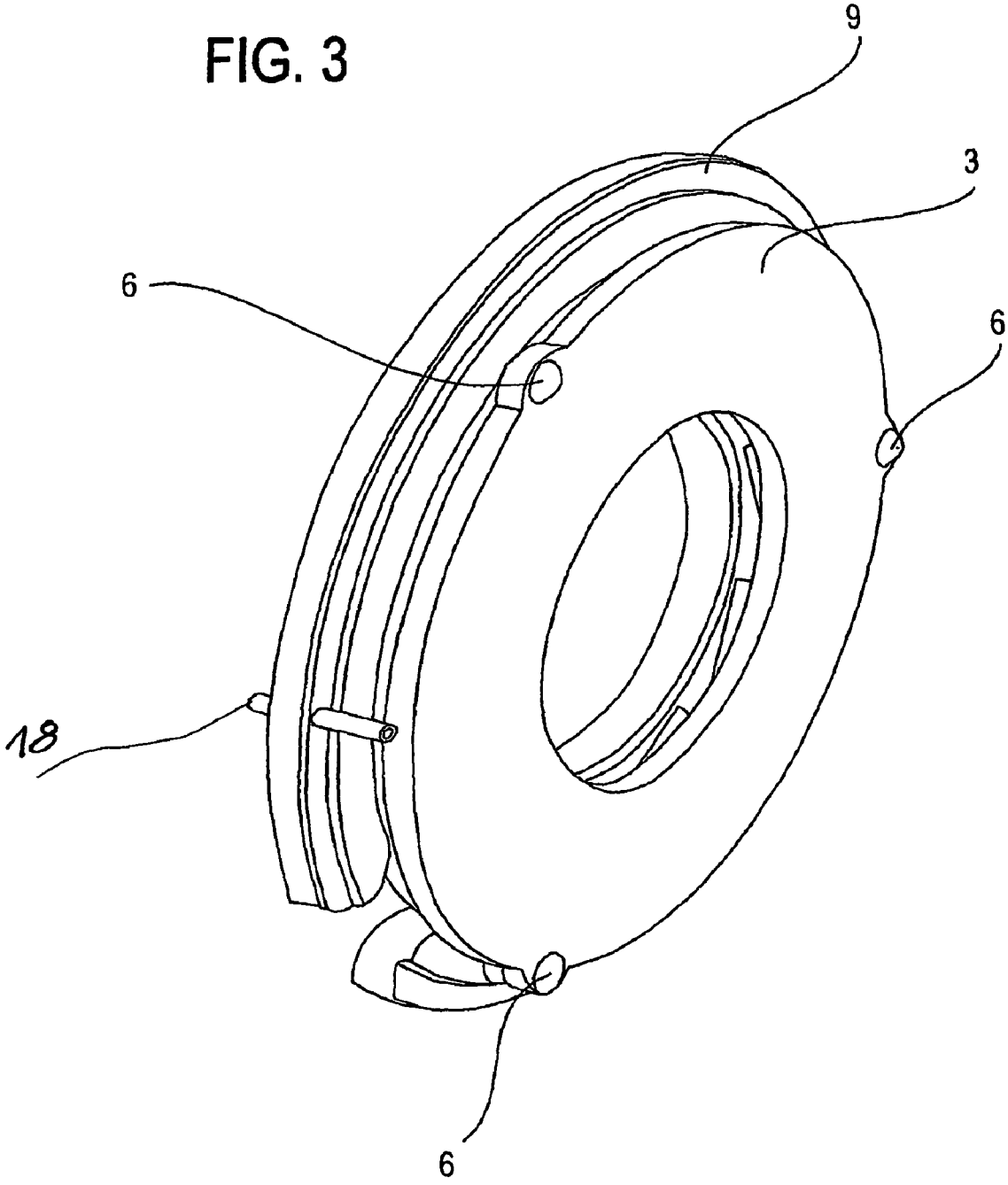
FIG. 3 shows a perspective view of the assembled vane cartridge of FIG. 1.

FIG. 3 shows a perspective view of the vane cartridge after the assembly is completed. In FIG. 3 it can be seen, that a guiding pin 18 is provided in order to ensure a correct angular position of the vane cartridge after it is inserted into a compressor housing 1, which arrangement is shown in FIG. 4.

Figure 4:
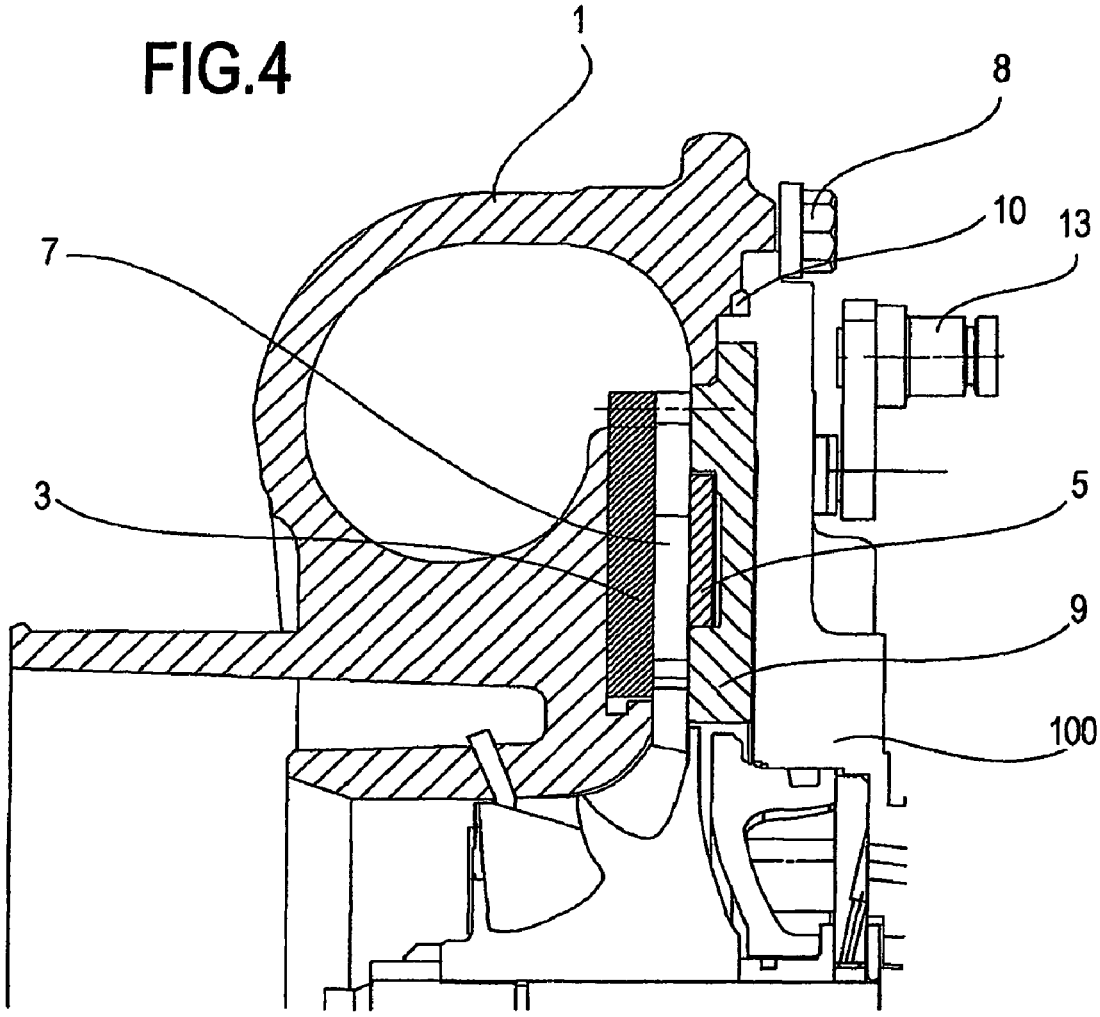
FIG. 4 shows a cross section of a variable geometry compressor housing having the vane cartridge of FIG. 1.

FIG. 4 is a sectional view of compressor housing 1 into which the vane cartridge according to the invention is inserted. Furthermore, the housing 1 has an inlet, a shroud groove, a volute, a diffuser plate 3 and a backplate 9.

The vane cartridge is inserted into the compressor housing 1 and then aerodynamically tested. Thereafter, the vane cartridge is fixed, together with the housing 1 to a center housing and rotating assembly (CHRA) 100 by bolts 8 at the side opposite the inlet. Thus, the components are secured. An O-ring 10 is provided between a CHRA 100 and the housing 1 to provide a seal. An actuation mechanism 13 connected to the vanes 7 for their actuation is provided on said CHRA 100 near a turbine housing. Thus, a final calibration of the vane cartridge is to be carried out only after fastening of the bolts 8 and securing of the housing 1 to the CHRA 100 is completed.

Alternatively the vane cartridge can be put into a special testing device for testing the functionality of the vane cartridge after it was assembled and before it is inserted into the housing 1.

A variable geometry compressor housing or a variable geometry compressor housing module may be used with a turbo charger of a combustion engine.

Basically, a turbo charger is a device that uses exhaust gases produced by the engine to supply additional air into cylinders of the combustion engine. The turbo charger is mounted directly to the exhaust manifold, where exhaust gases pass over a turbine impeller that is attached to a shaft.

On the other side of this shaft, a compressor wheel is provided, and is driven by the turbine via the shaft. The compressor wheel is located in a housing and draws suction air through an air filter, compresses this suction air and supplies it into an intake manifold of the engine via a volute in the housing. Thus, the energy from the exhaust gases, which would be wasted on a non charged engine, is being used to supply additional air into the combustion engine leading to an increased engine power.

Figure 5:
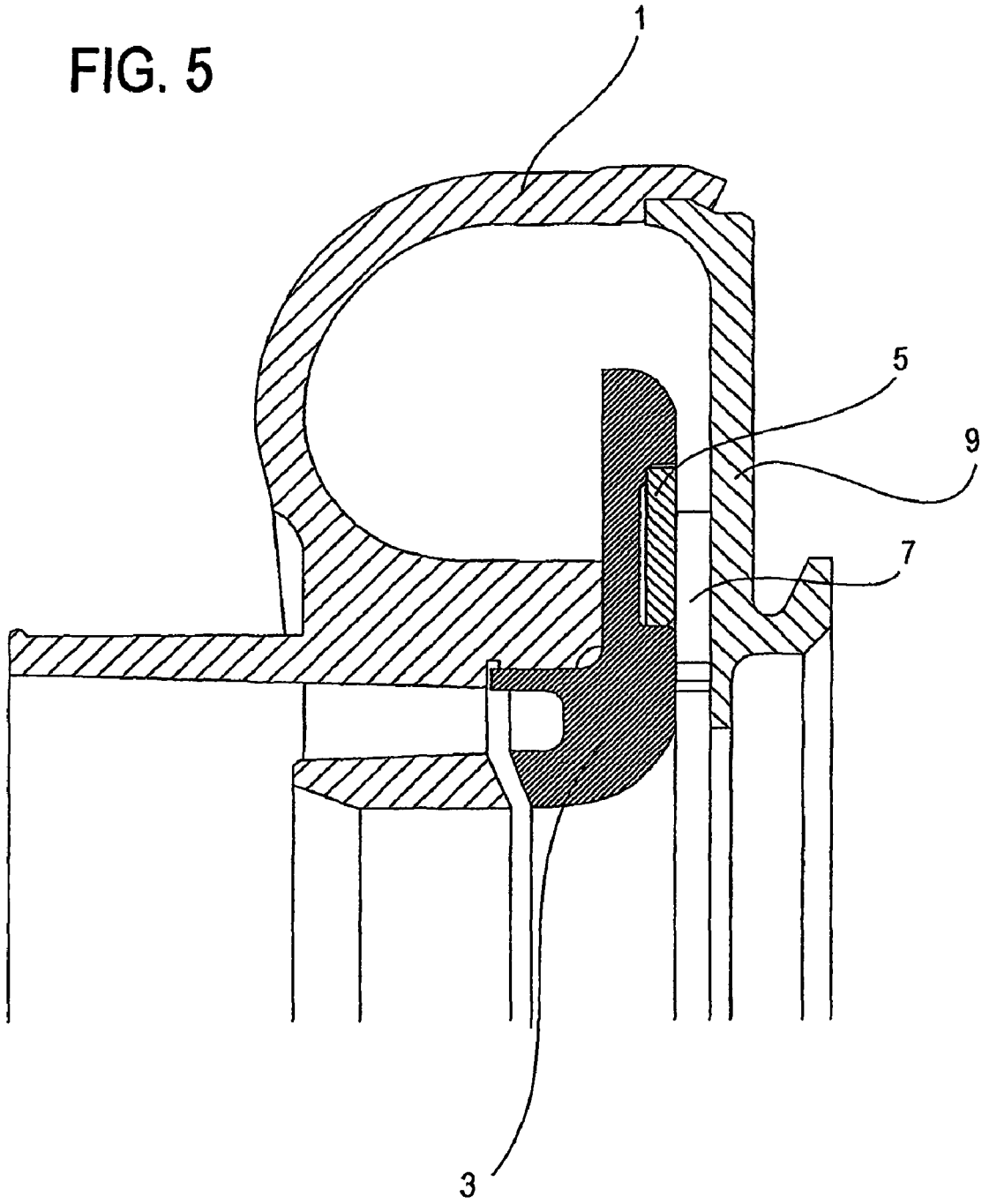
FIG. 5 shows a cross section of a variable geometry compressor housing according to the invention.

A presently preferred embodiment of the invention shall be described in the following:

FIG. 5 shows a cross section of a housing 1 for a variable geometry compressor according to an embodiment of the invention. The housing 1 is formed in a die casting process and it has an inlet and a portion of a shroud groove which is formed in the inlet. Furthermore, the housing 1 defines part of a volute.

A diffuser plate 3 is inserted into the housing 1 from a side opposite the inlet. The diffuser plate 3 has a radially outer portion which defines the remaining part of the volute. Thus, the volute is defined by the housing 1 in combination with the diffuser plate 3.

Furthermore, the diffuser plate 3 has an annular recess on its side opposite the volute. The recess houses a unison ring 5 to adjust a set of vanes 7.

A radially inner portion of the diffuser plate 3 is formed to define a bottom part of a shroud groove which has passages for passing a fluid such as e.g. suction air. An inner wall portion and an outer wall portion of the shroud groove are integral parts of the housing. Thus, not only the volute but also the shroud groove are defined by the housing 1 in combination with the diffuser plate 3.

A set of vanes 7 is supported between the unison ring 5 and a backplate 9. As described above, vanes 7 have a cylindrical projection or pivot axle on their one end portion, which is received by a circular hole in the diffuser plate 3. Furthermore, vanes 7 have a second projection or tab on their other end portion. The tab is housed in an oblique guiding slot provided in unison ring 5. Thus, by rotating unison ring 5, vanes 7 are rotated around the pivot axle in order to adjust an angle according to the rotational position of unison ring 5.

A radially outer portion of the backplate 9 is in engagement with the end portion of the housing 1. The backplate 9 is fixed to the housing 1 by a crimping process. Thus, no further fixing means or sealing means are required to ensure a fluid tight and stable connection. An attachment flange is provided on a radially inner portion of the backplate 9 opposite the volute.

Figure 6:
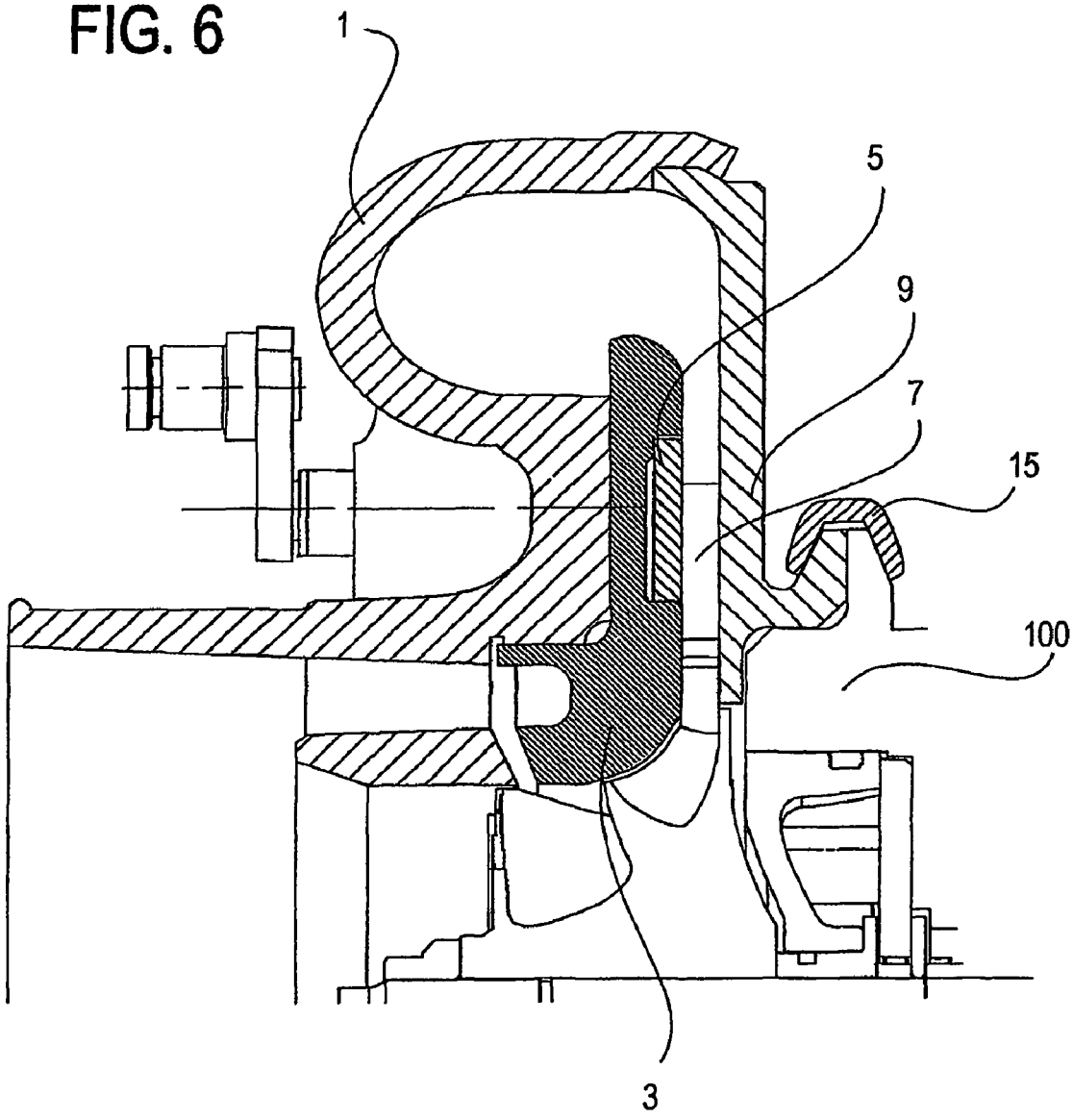
FIG. 6 shows a cross section of a variable geometry compressor housing module according to the invention.

As shown in FIG. 6, an actuation mechanism 13 for driving unison ring 5 is provided at the inlet side of housing 1. By inserting diffuser plate 3, unison ring 5 and vanes 7 into housing 1, and then fixing backplate 9, the inserted components are held between housing 1 and backplate 9. By fixing backplate 9 to housing 1, it is possible to completely assemble the variable geometry compressor housing module and to calibrate actuation mechanism 13, unison ring 5 and vanes 7 before the module is mounted to the reminder of a turbo.

The attachment flange of backplate 9 serves to attach the variable geometry compressor housing module according to the invention to a CHRA 100 by suitable attachment means. According to the embodiment, a V-band 15 is used for this purpose.

Besides facilitating the calibration, providing the actuation mechanism 13 on the inlet side of compressor housing 1 has the advantage that the actuation mechanism 13 is easily accessible and is provided in a relative cool area of the whole structure. Therefore, it is not necessary to provide additional measures for improving a heat resistance.

Figure 7:
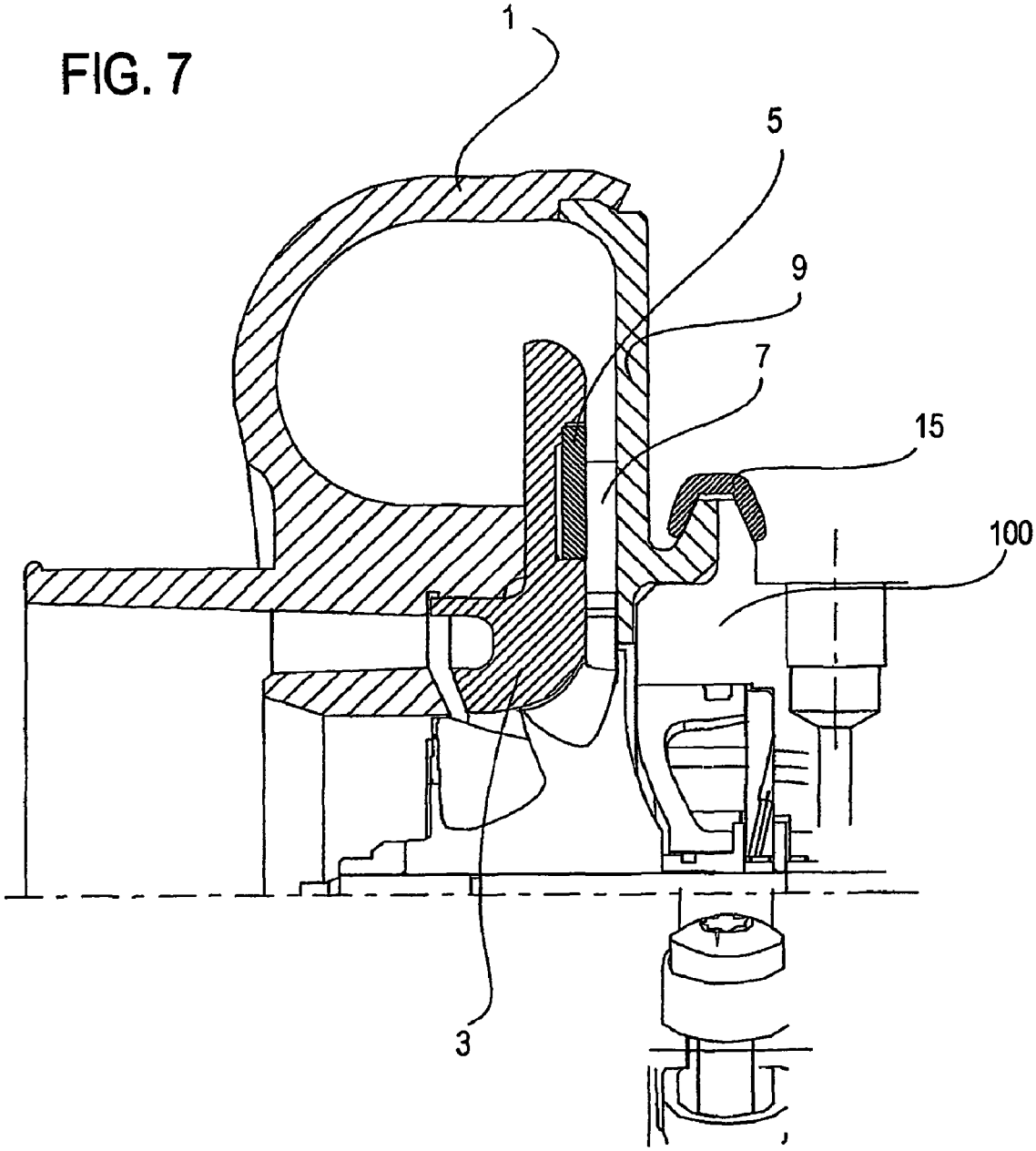
FIG. 7 shows a section of the variable geometry compressor housing module of FIG. 6, cut in a different plane where the cross section of the volute is increased.

FIG. 7 shows a section of the variable geometry compressor housing module, where the cross section of the volute is increased. Except for the cross sectional size of the volute of compressor housing, FIG. 7 corresponds with FIG. 6.

Figure 8:
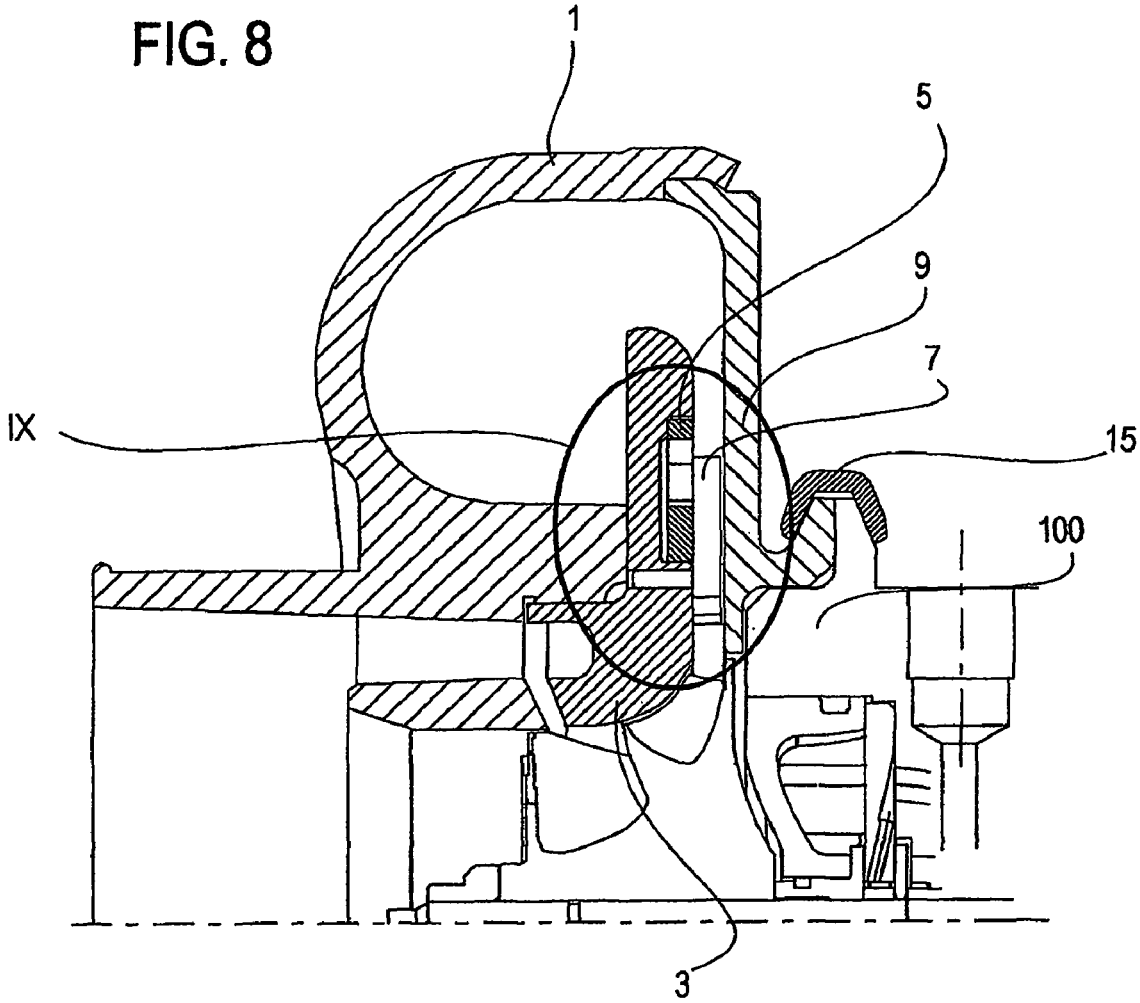
FIG. 8 shows a first example for arranging a set of vanes in a variable geometry compressor housing module according to the invention.
Figure 9:
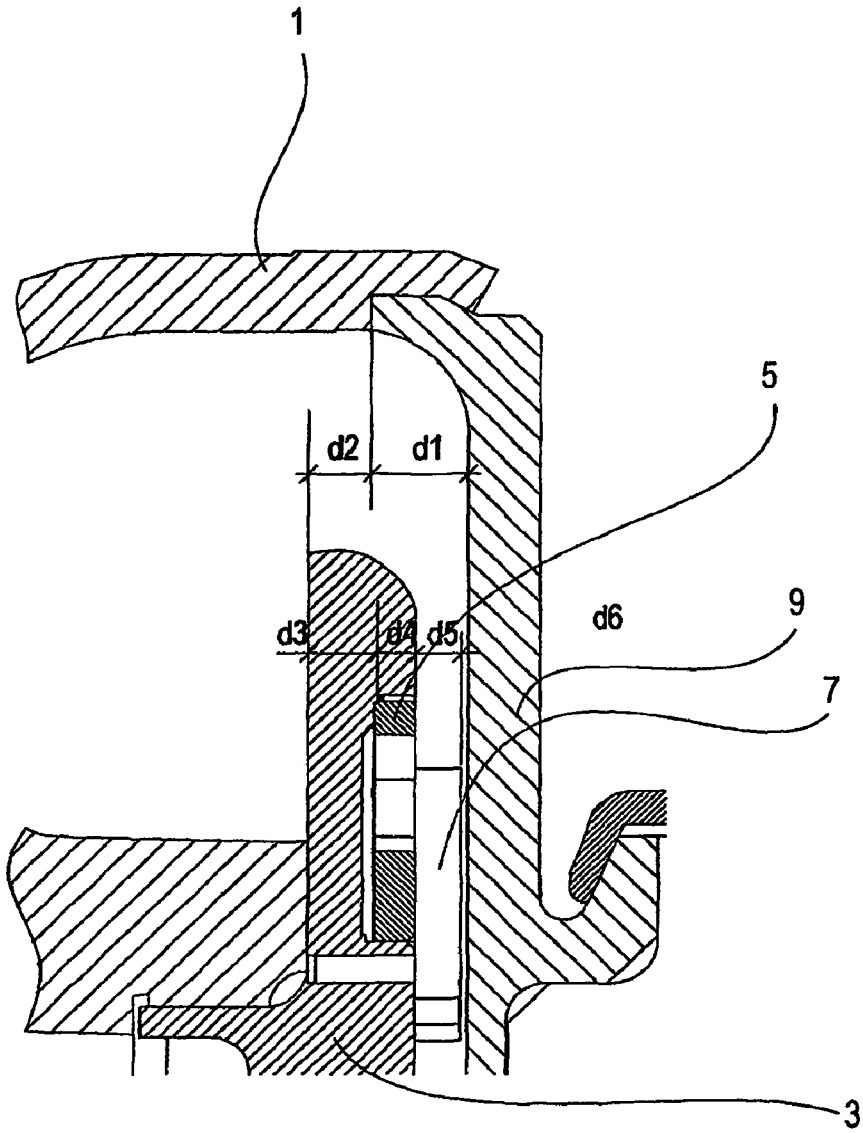
FIG. 9 shows a detail IX of FIG. 8 according to which a clearance between vanes and a backplate is estimated.

FIGS. 8 and 9 show a first example for a vane arrangement according to the invention. In order to ensure a smooth adjusting of vanes 7, a clearance is provided between vanes 7 and backplate 9.

FIG. 9 shows the detail IX of FIG. 8. It can be seen that a complicated machining procedure is necessary to obtain the required clearance d6.

Distance d1 is known from machining backplate 9, and is within a required tolerance range. Thickness d3 of diffuser plate 3, thickness d4 of unison ring 5 and thickness d5 of vanes 7 are also known and must be within required tolerance ranges. Thus, the required clearance d6 between vanes 7 and backplate 9 can be achieved by machining distance d2 which is the distance from the surface between housing 1 and backplate 9 to the surface between housing 1 and diffuser plate 3. By machining these two surfaces in one clamping, it is possible to adjust distance d2 and to obtain clearance d6.

Figure 10:
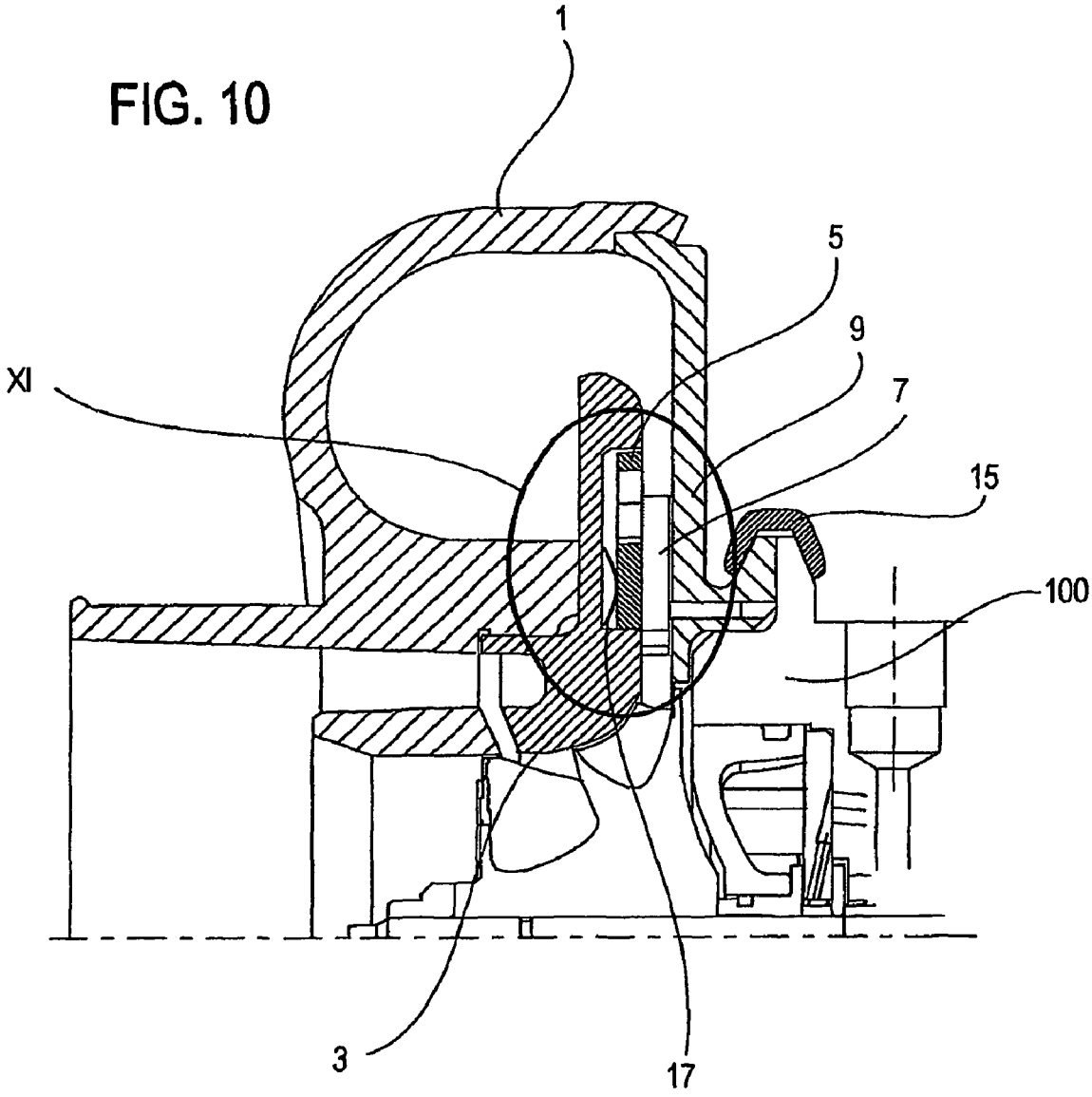
FIG. 10 shows a second example for arranging a set of vanes according to the invention.
Figure 11:
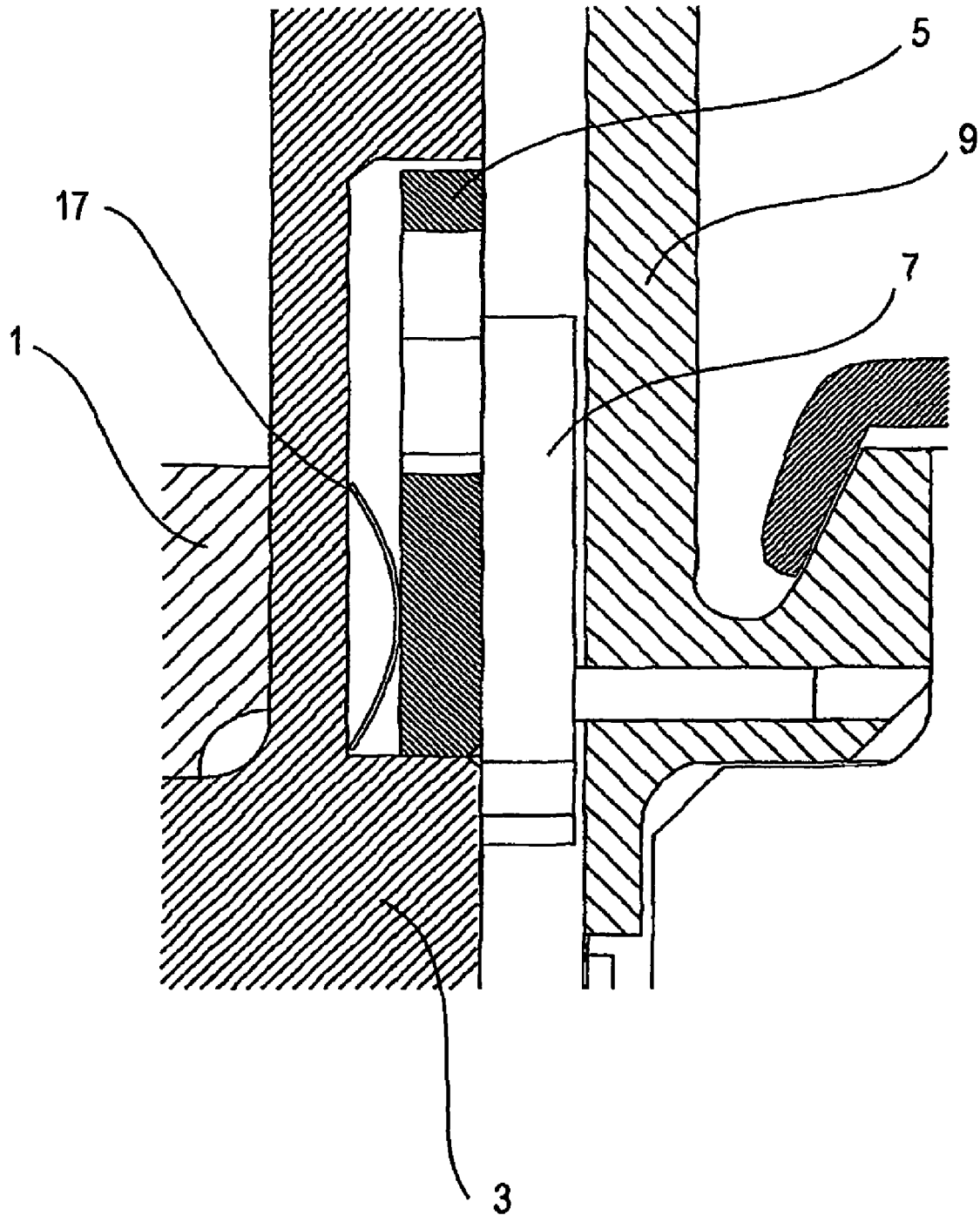
FIG. 11 shows a detail XI of the vane arrangement FIG. 10.

FIGS. 10 and 11 show a second example of the vane arrangement according to the invention. In FIGS. 10 and 11, components being different but having the same function as the components already described are identified by the same reference signs.

FIG. 10 shows the variable geometry compressor housing module having a slightly modified diffuser plate 3. Namely, the depth of the groove for housing a unison ring 5 is deeper than the thickness of the unison ring 5. Additionally, a spring 17 serving as biasing means is housed in the groove of diffuser plate 3.

FIG. 11 shows detail XI of FIG. 10. It can be seen from this figure that the pivot axle of each vane 7 is not supported in a hole of diffuser plate 9 but in a circular hole provided in backplate 9. Thus, the tab of each vane 7 and the pivot axle are provided on opposing faces of each vane 7. Furthermore, the contacting surfaces of unison ring 5 and backplate 9 are coated with a low friction coating.

Due to the biasing force of spring 17, unison ring 5 is pressed against vanes 7 and further against backplate 9. Since spring 17 can compensate a minor impreciseness of manufacturing, merely vanes 7 need to be accurately machined for their thickness to be within the required tolerance range.

According to the invention, one or more of the following advantages can be provided:

- The variable geometry compressor housing module according to the invention can be completely preassembled and calibrated before it is attached to another device.
- The variable geometry compressor housing module can be connected to another device such as e.g. a turbine by a simple flange connection which is easy to machine.
- Due to the crimping of the backplate and due to the flange connection, bolts and the provision of bolt holes are not required. Furthermore, due to the crimping, sealing means such as e.g. an O-ring can be saved.

The diffuser plate partly defines the shroud groove. Thus, a complicated manufacturing process can be avoided.

The diffuser plate also partly defines the volute. Thus, it is possible to manufacture the compressor housing in a die casting process which is faster and more economical than a sand casting process, where a lost core is used.

The vane clearance can be controlled by machining the surfaces between the housing and the backplate as well as between the housing and the diffuser plate in one clamping.

Providing a low friction coating with the backplate and the unison ring and biasing the latter makes it possible to compensate a minor manufacturing impreciseness, because no clearance between the vanes and the backplate is required.

The invention claimed is:

1. A variable geometry compressor device comprising:

a vane cartridge formed by two wall members that support a set of adjustable vanes and a unison ring for actuating said vanes between said two wall members wherein one of said wall members comprises a diffuser plate that comprises a groove for housing said unison ring.

2. The variable geometry compressor device according to claim 1, characterized in that each of said vanes has a pivot axle housed in a hole provided in one of said wall members and a tab housed in a guide slot provided in said unison ring.

3. The variable geometry compressor device according to claim 1 or claim 2, characterized in that a distance between said wall members is defined by spacers.

4. A method for manufacturing a variable geometry compressor device comprising:

providing two wall members wherein one of said two wall members comprises a diffuser plate that comprises a groove, inserting a unison ring in said groove of said diffuser plate and a set of vanes between said wall members, and attaching said wall members to each other to form a vane cartridge.

5. The method for manufacturing a variable geometry compressor system of claim 4, further comprising:

providing a compressor housing that comprises a volute and an inlet, inserting said vane cartridge into said housing, and attaching said housing to a center housing and rotating assembly.

6. A variable geometry compressor housing comprising:

an inlet, a volute, a shroud groove provided in said inlet, characterized by a diffuser plate a radially inner portion of which at least partly defines said shroud groove, and a backplate attached to said housing by crimping.

7. The variable geometry compressor housing according to claim 6, characterized in that a radially outer portion of said diffuser plate at least partly defines said volute, and in that the housing is formed in a die casting process.

8. The variable geometry compressor housing according to claim 6 or claim 7, characterized in that an actuation mechanism is located on an inlet side of said housing.

9. The variable geometry compressor housing module comprising a compressor housing according to claim 6 or claim 7, wherein said housing has a guide means for guiding a unison ring for actuating a set of adjustable vanes being supported by the backplate.

10. The variable geometry compressor housing module according to claim 9, characterized in that said guide means are provided in said diffuser plate on a side opposite the volute.

11. The variable geometry compressor housing module according to claim 9, characterized in that a clearance of said vanes is defined by machining of contact surfaces between said housing and said backplate and between said housing and said diffuser plate in one clamping.

12. The variable geometry compressor housing module according to claim 9, characterized in that said backplate has an attachment flange on a side opposite said volute.

13. The variable geometry compressor housing module according to claim 9, characterized in that that at least one of the opposing surfaces of said vanes and of said backplate, and/or of said unison ring or of said backplate and of said unison ring have a low-friction coating, and in that said vanes are pressed against said backplate by a biasing means arranged between said unison ring and said diffuser plate.

14. A method for manufacturing a variable geometry compressor housing module, comprising:

providing a die cast compressor housing, inserting a diffuser plate a radially outer portion of which at least partly defines a volute in said compressor housing, and inserting an assembly consisting of a unison ring, a set of vanes and a backplate into said housing such that said unison ring is housed in a groove provided in said diffuser plate, characterized in that said groove is at least partly defined by a radially inner portion of said diffuser plate, and in that said backplate is attached to said compressor housing by crimping.

15. The method for manufacturing a variable geometry compressor housing module according to claim 14, characterized in that it further comprises machining a contact surface between said housing and said backplate, and machining a contact surface between said housing and said diffuser plate in one clamping, in order to adjust a distance of said set of vanes to said backplate.

16. The method for manufacturing a variable geometry compressor housing module according claim 14 or 15, characterized in that it further comprises coating at least one of the opposing surfaces of said vanes and of said backplate, of said unison ring or of said backplate and said unison ring with a low friction coating.

17. The method for manufacturing a variable geometry compressor housing according to claim 14, characterized in that it further comprises providing an actuation mechanism on an inlet side of said housing.

18. A variable geometry compressor housing comprising:

an inlet, a separate diffuser plate, a volute defined at least partly by a radially outer portion of said separate diffuser plate, and a shroud groove provided in said inlet, characterized in that an actuation mechanism is located on an inlet side of said housing.

19. The variable geometry compressor housing according to claim 18, characterized in that a backplate is attached to said housing by crimping.

20. The variable geometry compressor housing according to claim 18, characterized in that a radially inner portion of said separate diffuser plate at least partly defines said shroud groove.

21. The variable geometry compressor housing module comprising a compressor housing according to claim 18, wherein said housing has a guide means for guiding a unison ring for actuating a set of adjustable vanes being supported by a backplate which is fixed to said housing.

22. The variable geometry compressor housing module according to claim 21, characterized in that said backplate is fixed to said housing by crimping.

23. The variable geometry compressor housing module according to claim 21, characterized in that said guide means are provided in said separate diffuser plate on a side opposite said volute.

24. The variable geometry compressor housing module according to claim 21, characterized in that a clearance of said vanes is defined by machining of contact surfaces between said housing and said backplate and between said housing and said separate diffuser plate in one clamping.

25. The variable geometry compressor housing module according to claim 21, characterized in that said backplate has an attachment flange on a side opposite said volute.

26. The variable geometry compressor housing module according to claim 21, characterized in that at least one of the opposing surfaces of said vanes and of said backplate, of said unison ring or of said backplate and of said unison ring have a low-friction coating, and in that said vanes are pressed against said backplate by a biasing means arranged between said unison ring and said diffuser plate.

27. A method for manufacturing a variable geometry compressor housing module, comprising:

providing a die cast compressor housing, inserting a diffuser plate a radially outer portion of which at least partly defines a volute in said compressor housing, and inserting an assembly consisting of a unison ring, a set of vanes and a backplate into said housing such that said unison ring is housed in a groove provided in said diffuser plate, characterized in that an actuating mechanism is provided on an inlet side of said housing, and in that said backplate is attached to said compressor housing by crimping.

28. The method for manufacturing a variable geometry compressor housing module according to claim 27, characterized in that it further comprises machining a contact surface between said housing and said backplate, and machining a contact surface between said housing said diffuser plate in one clamping, in order to adjust a distance of said set of vanes to said backplate.

29. The method for manufacturing a variable geometry compressor housing module according to claim 27 or 28, characterized in that it further comprises coating at least one of the opposing surfaces of said vanes and of said backplate, of said unison ring or of said backplate and of said unison ring with a low friction coating.

30. The method for manufacturing a variable geometry compressor housing module according to claim 27, characterized in that said shroud groove is at least partly defined by a radially inner portion of said inserted diffuser plate.

31. A variable geometry compressor housing comprising:

an inlet, a volute, a shroud groove provided in said inlet, characterized by a diffuser plate, a radially inner portion of which at least partly defines said shroud groove, and a guide means for guiding a unison ring disposed at least partially in said shroud groove for actuating a set of adjustable vanes being supported by a backplate fixed to said housing.

* * * * *